United States Patent [19]

Rymer

[11] 3,992,074

[45] Nov. 16, 1976

[54] SEGMENTED ELECTRIC TERMINAL STRIP

[75] Inventor: Phillip R. Rymer, Leicester, N.C.

[73] Assignee: Square D Company, Park Ridge, Ill.

[22] Filed: Mar. 12, 1975

[21] Appl. No.: 557,852

[52] U.S. Cl. ..... 339/198 GA
[51] Int. Cl.[2] ..... H01R 9/22
[58] Field of Search ..... 339/198 GA, 198 R, 198 G, 339/198 H

[56] References Cited

UNITED STATES PATENTS

| | | | |
|---|---|---|---|
| 2,981,922 | 4/1961 | Van Valkenburg et al. | 339/198 GA |
| 3,123,425 | 3/1964 | Blanchet | 339/198 GA |
| 3,173,738 | 3/1965 | Gluntz | 339/198 GA |
| 3,236,975 | 2/1966 | De Smidt et al. | 339/198 GA |

*Primary Examiner*—Roy Lake
*Assistant Examiner*—Craig R. Feinberg
*Attorney, Agent, or Firm*—William H. Schmeling; Harold J. Rathbun

[57] ABSTRACT

A terminal strip including a plurality of terminal blocks arranged in a row in side-by-side abutting relation by a pair of end clamps on a channel-shaped track. The track has an apertured base disposed between upturned side walls which terminate in respective outwardly turned flanges. Each terminal block comprises an open-sided molded part having a pair of spaced leg-like extensions extending downwardly from a juncture with the respective opposite side walls of the part and a bottom wall spaced between the leg-like extensions. The bottom wall is positioned between portions of the top side of the flanges of the track while flanges at the free ends of the leg-like extensions grip rear surface portions on the flanges to tightly position the block on the track. One of the leg-like extensions terminates in a lever comprising said flange and an outwardly and upwardly extending lever portion, and includes a necked portion joining a midpoint of said lever and said juncture. The lever portion is manually movable to flex its associated leg-like extension so the flange portion at the free end of the leg-like extension moves outwardly and out of engagement with the outwardly turned flange portion on the track to permit the block to be installed or removed from the track. A stop is provided to limit the flexure of the lever carrying leg-like extension to prevent damage of the part when it is installed or removed from the track.

8 Claims, 5 Drawing Figures

SEGMENTED ELECTRIC TERMINAL STRIP

BACKGROUND OF THE INVENTION

Electric terminal strips are commonly mounted on electric panels to provide a series of spaced terminals that facilitate wiring connections with external apparatus, as well as tracing the circuits on the panel. Electric terminal strips formed of modular terminal connector blocks are well known and are frequently used to provide the exact number of terminals required for the specific circuit on a panel. As a circuit modifications are frequently made to circuits previously wired on a panel, it is desirable that such terminal strips be assembled from individual, non-interlocking terminal blocks which are mounted upon a common track so that the number of terminal blocks on the track may be easily changed and additional blocks added to the assembly after the terminal strip is installed on a panel. Thus a need exists for a terminal block which can be installed or removed from a mounting track preferably without resorting to a tool using judicious prying pressure and which has a construction which will clearly visually indicate when the individual blocks are improperly mounted on the track.

SUMMARY OF THE INVENTION

An improved releasable terminal block in accordance with this invention is easily mounted on or removed from a channelshaped track. The terminal block comprises a molded opensided part having a downwardly extending bottom wall and leglike extensions which cooperate to hold the terminal block to the track. The leg extensions have inturned flanges at their free ends. One of the leg extensions terminates in a lever including said flange and an elongated lever portion extending outwardly and integral with one of the leg extensions, thus enabling that leg extension to be flexed outwardly to increase the separation between the flanges on the free ends of the leg extensions and provide clearance between the flanges on the part and the flange portions on the track. When the flexing force is removed from the lever portion, the flexed leg extension returns to its normal position. A pair of open grooves, one on each side of the leg extension carrying the lever portion, facilitates flexing of the leg-like extension when a manual force is applied to the lever portion.

It is an object of this invention to provide an improved terminal strip comprised of a plurality of track mounted terminal blocks which are transversely releasable from the track either manually or by the use of a prying tool.

Another object is to provide an improved terminal block having a releasing lever portion which, in conjunction with a stop means, can be depressed only a fixed distance when mounting or removing the terminal block from the track.

Another object is to provide a terminal block which may be mounted at a plurality of positions along a track.

Still another object is to provide a terminal block which provides a visual means of the orientation of the block on the track.

BRIEF DESCRIPTION OF THE DRAWINGS

Other objects and advantages of the invention will become apparent from the following description where reference is made to the drawings, in which.

DETAILED DESCRIPTION OF THE INVENTION

Figure 1:
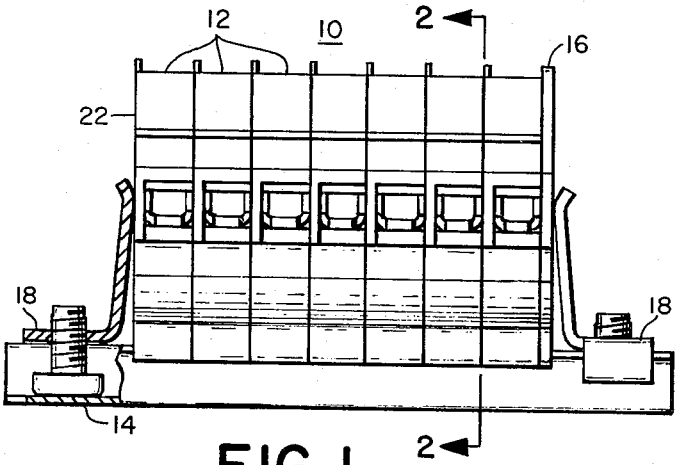
FIG. 1 is a view in elevation of an electric terminal strip in accordance with this invention and showing several terminal blocks mounted in a row on a channel-shaped track between a pair of end clamps.

Referring principally to FIG. 1, the invention is described herein as embodied in an electrical terminal strip 10 comprising a plurality of individual terminal blocks 12 mounted on a channel-shaped track 14 in a row in side-by-side abutting relation. A barrier member 16 covers an open side of an end one of the terminal blocks 12, and the blocks 12 are held in the abutting side-by-side relation by a pair of end clamps 18.

Figure 2:
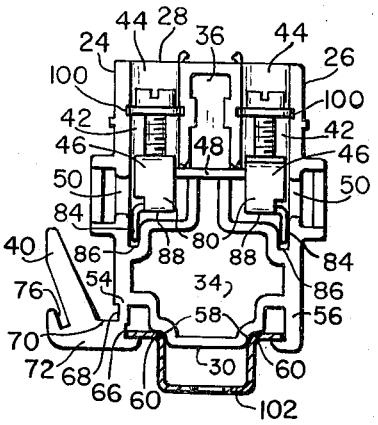
FIG. 2 is a sectional view taken generally along the line 2—2 of FIG. 1.
Figure 4:
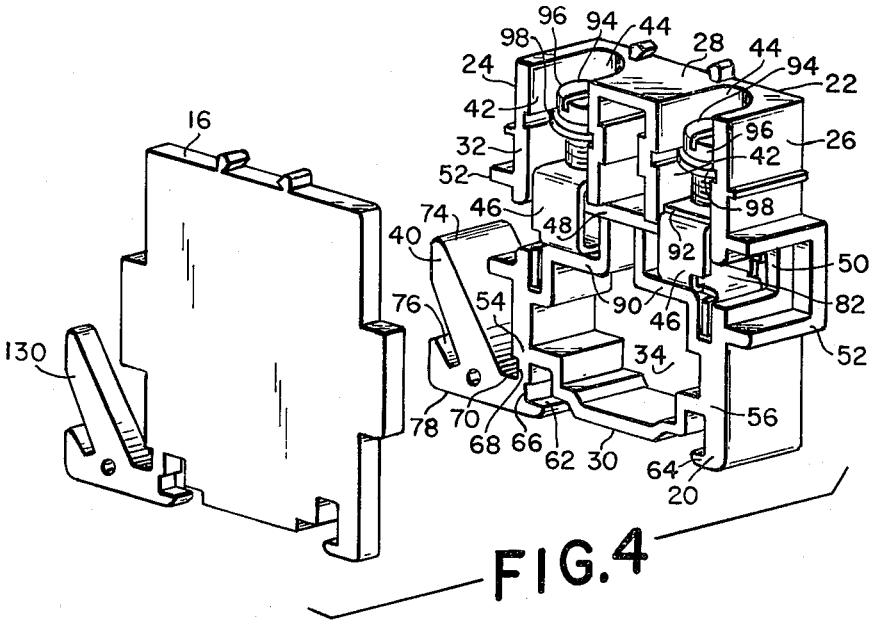
FIG. 4 is a partially exploded view of one of the terminal blocks in FIG. 1 and a barrier member therefore.
Figure 5:
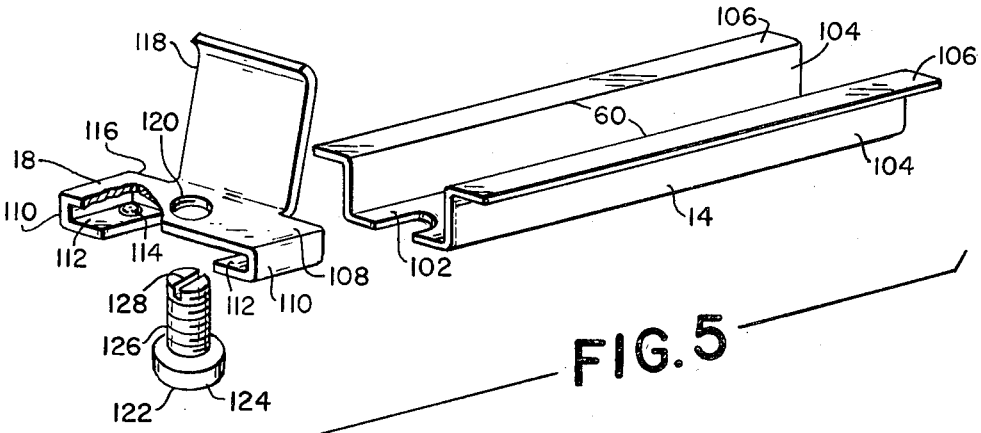
FIG. 5 is an exploded view showing the track and one of the end clamps in FIG. 1.

Referring now principally to FIGS. 2 and 4, each terminal block 12 comprises an open-sided molded part 20 of insulating material having an uninterrupted end wall 22, a pair of opposed side walls 24 and 26, a top wall 28, a bottom wall 30 and an end wall 32 having recesses 34 and 36 extending inwardly in the part between the end walls 32 and 22.

The part 20 is formed of a molded renitent synthetic material, such as nylon. A renitent synthetic material will resist deformation and yet provide sufficient resiliency to permit portions thereof to be flexed without fracturing and without requiring excessively high force to cause flexure of the portions. The recesses 34 and 36 are included in the part 20 to reduce the material required to form the part 20 and are sized and located so the wall thicknesses of the part 20 are uniform, as dictated by good molding practices. To impart the required rigidity to the part 20, if required, a reinforcing rib structure, not shown, having two diagonally disposed intersecting members may be molded within the recess 34. The part 20 also includes an elongated lever portion 40, to be later described in detail, that extends outwardly and upwardly from a lower portion of the wall 24 and a pair of recesses 42 located on opposite sides of the recess 36 that extend through openings 44 in the top wall 28.

The recesses 42 receive respective box lug connectors 46 which are electrically interconnected by a bus bar 48 received in slots in opposed walls of the part 20 which define the recesses 34 and 36. Respective conductor receiving openings 50 in the side walls 24 and 26 communicate with the respective recesses 42 and are surrounded at their outer ends by respective C-shaped flange portions 52.

The side walls 24 and 26 of each terminal block 12 have respective downwardly extending leg extensions 54 and 56 which extend from a juncture with the block in spaced relation to a lower portion of the bottom wall 30. The bottom wall 30 merges with the walls 24 and 26 at the juncture with the upper extremities of the leg extensions 54 and 56 and has stepped portions defining a pair of rounded grooves 58 so that the outer configuration of the grooves 58 in bottom wall 30 is complementary to curved upper end surface portions 60 of the track 14.

The leg extensions 54 and 56 are relatively short and narrow in vertical cross-section and have respective inturned hook-like flanges 62 and 64 at their lowermost free ends. The extension 54 has an inwardly opening groove 66 and an outwardly opening groove 68 extending throughout the entire length of the extension thereby providing flexibility to the leg extension 54. A lower side of the groove 68 is coplanar with an upper side 70 of a connecting portion 72 which connects the leg extension 54 to the lever portion 40. Further, the lower side of the groove 68 is generally coplanar with an upper side of the groove 66.

When a force is applied inwardly against the outer surface of the actuator 40, as by amnually pushing the upper free end 74 toward the wall 24, the integral assembly of the actuator 40, connecting portion 72 of extension 54, and flange 62 become a lever fulcrummed about the juncture with the block whereby the lower portion of the leg extension 54 rotates generally about a fulcrum defined by the plane of the lower side of the groove 68 and the upper side of the groove 66. Alternatively, the lever portion 40 may be forced toward the wall 24 by the side of a prying tool, such as a screwdriver, received in a wedge-shaped, downwardly extending slot 76 formed in a lower outer face of the lever portion 40 intermediate the free end 74 and lower end 78 of the lever portion 40. As the leg extension 54 rotates, the inturned flange 62 moves outwardly, thus increasing the separation between the flanges 62 and 64. When the pressure applied to the lever portion 40 is removed, the flange 62 returns to its normal position because of the renitent material from which the part 20 is molded.

The two box connectors 46 are fixedly disposed within the respective recesses 42 of each terminal block and each connector 46 comprises a portion 80 having walls defining a rectangular conductor receiving chamber 82 which is aligned with the openings 50 in the side walls 24 and 26 to receive a conductor (not shown). Each portion 80 has a flattened projection 84 which extends downwardly and is received in a recess 86 in the part 20. When the connectors 46 have their chambers 82 in the fully opened position, respective lower sides 88 of the portions 80 rest on respective upper wall portion 90 of the recess 34. Each connector 46 has an over-lapped top portion 92 provided with concentric openings, at least one of which is threaded to receive a screw 94. A head portion 96 of each screw 94 has a collar 98, which is received by opposing grooves 100 in the side walls of its recess 42 preventing vertical movement of the screw 94 as it is turned. When the screws 94 are rotated, the respective portions 80 move upwardly on the threaded shanks of the screws 94. Thus, the lower sides 88 of the portions 80 move toward the underside of the bus bar 48 thereby to clamp conductors (not shown) positioned therebetween.

The channel-shaped track 14 includes a slotted base 102 disposed between a pair of upright side walls 104 which terminate in outwardly turned flanges 106.

The end clamps 18 are provided to prevent longitudinal movement of a series of terminal blocks 12 mounted on the track 14 and to clamp the blocks 12 together. Each clamp 18 comprises a metal stamping having a body portion 108 provided with inturned end portions 110 to define a pair of slots 112. Bosses 114 are formed on the upwardly directed surface of the inturned end portions 110 near one side 116 of the body portion 108. A resilient clamping finger 118 extends upwardly from the side 116 of the body portion 108 and a threaded opening 120 passes through the center of the body portion 108 for receiving a screw 122. The screw 122 has an enlarged head 124 and a threaded shank 126 having a slotted end face 128.

When the terminal blocks 12 are assembled on the track 14, each of the terminal blocks 12 may be mounted on the track 14 by transverse movement of the block 12 with respect to the track 14. This is accomplished by hooking the flange 64 of the leg extension 56 under one of the outwardly turned flange portions 106 of the track 14. The other leg extension 54 is then flexed outwardly by manually pushing the lever portion 40 toward the wall 24 of the terminal block 12, thus moving the flange 62 on the leg extension 54 outwardly to clear the outer edge of the other one of the flange portions 106, thereby allowing the terminal block 12 to rotate downwardly into place on the track 14. After the flange portion 106 is cleared by the flange 62, the manual force on the lever portion 40 is released and the leg extension 54 returns to its normal position beneath the flange portion 106. The bottom wall 30, the leg extensions 54 and 56 and the flanges 62 and 64 then grip the track 14 to secure the terminal block 12 thereto. The transverse method of mounting the blocks 12 is particularly useful to alter terminal strips previously assembled, or for assembling terminal strips in restricted areas where the track 14 is already mounted upon a panelboard.

Removal of a terminal block 12 from the track 14 is similarly accomplished by flexing the leg extension 54 by pushing the lever portion 40 on the terminal block 12 to be removed toward its associated wall 24 until the flange 62 clears the outer edge of its associated flange portion 106. The terminal block 12 is rotated relative to the track 14 and then is moved away from the track 14 by a lateral movement before the lever portion 40 is released.

The blocks 12 are molded of relatively stiff insulating material, but the flexibility of the leg extension 54 is improved by virtue of the grooves 66 and 68. As mentioned above, the bottom of the groove 66 and the top of the groove 68 are generally coplanar. The lever portion 40 and the flange 62 constitute a lever and, when the lever portion 40 is pushed toward the wall 24, the leg extension 54 rotates or bends at the plane which acts as a fulcrum for the lever portion 40. Since the distance from the fulcrum to the flange 62 is relatively small when compared to the distance from the fulcrum to the upper end 74 of the lever portion 40, and since the free end 74 is disposed above the fulcrum, a small manual force applied inwardly to the free end 74 of the lever portion 40 provides a relatively large moment of force which flexes the leg extension 54 and flange 62 outwardly away from the remainder of the part 20. Thus it is not necessary to employ a prying tool, such as a screwdriver, when installing or removing a terminal block 12. When it is desired to use a screwdriver, the tip of the screwdriver is placed within the wedge-shaped receiving slot 76 and the shank of the screwdriver engages the free end 74 as the handle of the screwdriver is rotated toward the side 24. A moment is thus applied to the leg extension 54 and it flexes so that the inturned flange 62 can clear the outer edge of the associated flange portion 106.

The length of the connecting portion 72 displaces the lever portion 40 a sufficient distance away from the leg extension 54 so that, when the lever portion 40 is pushed toward the wall 24, the inner side of the lever portion 40 contacts the outer face of one of the flange portions 52 only after the flange 62 has been moved outwardly to a position which clears the flange portion 106. The outer face of the flange portion 52 thus serves as a stop means preventing the application of undue bending pressure to the lever portion 40 and the possibility of damage to the leg extension 54. The stop means provides a convenient aide in the normal use of the terminal block. For example, the part 20 may be manually tripped with a thumb and forefinger engaging the wall 26 and free end 74 on the lever 40. Firm pressure may be directly applied to the lever 40 as the terminal block 12 is moved into position on the track 14 without concern of undue pressure being applied which otherwise could result in damage to the leg extension 54.

Each terminal block 12 grips the track 14 in such a manner that positive action is required to dislodge the terminal block 12, thereby preventing the possibility of accidental removal. For example, each terminal block 12 is restrained against upward movement by engagement of the flanges 62 and 64 with the underside of the outwardly turned flange portions 106 and downward movement is prevented by engagement of the downwardly facing grooved portions 58 and with the rounded top surfaces 60 of the flange portions 106 at their area of intersection with the upright side walls 104. Further, lateral movement of each block 12 is prevented by the inner sides of the leg extensions 54 and 56 engaging the outer edges of the respective flange portions 106 and the grooved portions 58 engaging the inner surface portions of the upright side walls 104. By thus gripping the track 14 in all directions and because of the limited flexibility of the leg extensions 54 and 56, a positive action is required to dislodge the blocks from the track 14.

When a series of blocks 12 are mounted upon the track 14, the exposed open side of the terminal block 12 at one end of the series may be closed by the insulating barrier member 16. The barrier 16 has a configuration similar and corresponding to the outline of the terminal blocks 12 including a lever potion 130, which extends outwardly from one side and a bottom surface and leg extensions for engaging the track 14 in the same manner as the terminal blocks 12 engage the track 14 as previously described.

Figure 3:
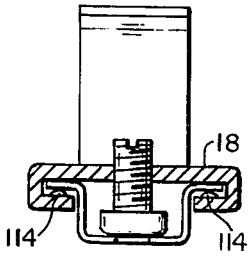
FIG. 3 is an end view of one of the end clamps shown in FIG. 1.

After a series of the terminal blocks 12, including a barrier 16, have been mounted on the track 14, an end clamp 18 is mounted at each end of the series to prevent longitudinal movement of the terminal blocks 12 of the series. The screw 122 of each clamp 18 is initially threaded through its associated opening 120 with the slotted end face 128 directed upwardly. The screw 122 is turned until the enlarged head 124 clears the slotted base 102 of the track 14 when the clamp 18 is slipped onto the track 14 as shown in FIG. 3. One of the clamps 18 is positioned so that the upright clamping finger 118 thereof abuts outside the uninterrupted end wall 22 of one of the endmost terminal blocks 12 and the other clamp 18 is positioned so that its finger 118 abuts the barrier 16. The slotted end face 128 of each screw 122 is engaged by a screwdriver and turned inwardly of the threaded opening 120 causing the screw 122 to move downwardly toward the base 102. The enlarged end 124 will then push against the base 102 while the bosses 114 contact and press against the underside of the outwardly turned flange portions 106. As the screw 122 is further turned, the end bracket 18 pivots around the point of contact of the bosses 114 and the flange portion 106, causing the finger 118 to press firmly against its adjacent terminal block 12 or the barrier 16, thus holding the series of terminal blocks tightly together and preventing accidental removal thereof.

Additional terminal blocks 12 may be added to either end of the series merely by removing one of the brackets 18. The bracket 18 may then be reinstalled as described above.

It will be apparent from the above description that an electric terminal strip of this invention may be tailored to meet individual needs by the provision of non-interlocking blocks individually mounted upon a common track at a variety of positions along the track. Additions, substitutions and repairs to the terminal blocks may be made without completely disassembling the series of blocks. Each terminal block securely grips the track until released either manually or by means of a prying tool.

Further, as the parts 20 are provided with recesses 42 which receive the box lug connectors 46 and a slot which receives the bus bar 48, assembly of the connectors 46 and bus bar 48 is easily accomplished by inserting the parts from the open end wall 32 into their proper recesses and slot. However, as these current carrying parts are exposed to the open end wall 32 side of the part 20, when two adjacent terminal blocks 12 are incorrectly mounted on the track 14, the current carrying parts of the adjacent blocks will be in close proximity and will not have the proper electrical clearance therebetween. However, this condition will be readily apparent as the lever portions 40 on the improperly oriented blocks 12 will point in opposite directions to clearly indicate when a terminal block 12 is improperly mounted on the track 14.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. An electric terminal strip comprising: a channel-shaped mounting track having laterally spaced side walls that have respective outwardly turned flange portions at their upper edges. a plurality of individual terminal blocks of renitent insulating material removably mounted on the track transversely thereof and disposed in side-by-side abutting relation in a row lengthwise on the track, each of said blocks including a pair of opposed side walls, a bottom wall extending between the side walls having a bottom wall portion engaging the upper surfaces of the flange portions, each of said side walls having respective leg extensions extending downwardly from a juncture with said block outwardly of the respective flange portions, said leg extensions terminating at their lower extremities in respective end portions having inturned flanges disposed beneath and engaging the respective flange portions of the track, said end portion of one of said leg extensions comprising a lever including its respective inturned flange and a lever portion extending outwardly and upwardly therefrom said one leg extension including a fulcrum disposed between said juncture and said end portion, said lever portion terminating in a free end disposed above a horizontal plane including said fulcrum, said lever portion having an inner surface facing and spaced from the side wall associated with said one extension and an outer surface facing away from said side wall and comprising a force engageable surface whereby force applied inwardly thereto is effective to flex said lever about said fulcrum to a position whereat the flange thereof is moved outwardly from its position beneath its associated flange portion on the track to permit rotary movement of the terminal block relative to the track during removal and installation of the block on the track.

2. A terminal strip as claimed in claim 1 wherein a tool receiving portion is provided near the area of junction of the lever portion with said one leg extension to permit a tool to have a portion received in said tool receiving portion and to be engaged against said force engaging surface to flex said one leg extension.

3. A terminal strip as claimed in claim 1 wherein said one leg extension has a groove in one of its side walls for increasing its flexibility.

4. A terminal strip as claimed in claim 3 wherein said one leg extension also has a groove in its other side wall for increasing its flexibility.

5. A terminal strip as claimed in claim 1 wherein the lever portion of each block is so shaped and positioned that it engages a stop surface on an adjacent side wall of the block upon movement thereof sufficient to move the flange of said one leg extension from its position below its associated flange portion of the track.

6. A terminal strip as claimed in claim 5 wherein said stop surface is the outer surface of a projection extending outwardly from the adjacent side wall of the block.

7. An electric terminal strip comprising: a channel-shaped mounting track having laterally spaced side walls that have respective outwardly turned flange portions at their upper edges, a closure member of renitent insulating material removably mounted on the track transversely thereof for closing an open side of an end block of a row of blocks disposed in side-by-side abutting relation in a row lengthwise on the track, the closure member including a pair of opposed side walls, a bottom wall portion engaging the upper surfaces of the flange portions, each of said side walls having respective leg extensions terminating at their lower extremities in respective end portions having inturned flanges disposed beneath and engaging the respective flange portions of the track, said end portion of one of said leg extensions comprising a lever including its respective inturned flange and a lever portion extending outwardly and upwardly therefrom, said one leg extension including a fulcrum disposed between said juncture and said end portion, said lever portion terminating in a free end disposed above a horizontal plane including said fulcrum, said lever portion having an inner surface facing and spaced from the side wall associated with said one extension and an outer surface comprising a force engageable surface whereby force applied inwardly thereto is effective to flex said lever about said fulcrum to a position whereat the flange thereof is moved outwardly from its position beneath its associated flange portion on the track to permit rotary movement of the terminal block relative to the track during removal and installation of the block on the track.

8. An electric terminal block for removably mounting transversely on a channel-shaped mounting track having laterally spaced side walls that have respective outwardly turned flange portions at their upper edges, said block being of renitent insulating material and having a pair of opposed side walls, a bottom wall extending between the side walls having a bottom wall portion engaging the upper surfaces of the flange portions and each of said side walls having respective leg extensions extending downwardly from the bottom wall outwardly of the respective flange portions with said leg extensions terminating at their lower extremities in respective end portions having inturned flange portions disposed beneath and engaging the respective flange portions of the track when the block is mounted on the track, the end portion of the only one of said leg extensions comprising a lever including its respective inturned flange and a lever portion extending outwardly and upwardly therefrom, said one leg extension including a fulcrum disposed between said juncture and said end portion, said lever portion terminating in a free end disposed above a horizontal plane including said fulcrum, said lever portion having an inner surface facing and spaced from the side wall associated with said one extension and an outer surface facing away from said side wall and comprising a force engageable surface whereby force applied inwardly thereto is effective to flex said lever about said fulcrum to a position whereat the flange thereof is moved outwardly from its position beneath its associated flange portion on the track to permit rotary movement of the terminal block relative to the track during removal and installation of the block on the track, whereby the presence of said lever portion on only one of said leg extensions provides a visual indication of the orientation of the block on the track.

* * * * *